US005326278A

United States Patent [19]

Logerot et al.

[11] Patent Number: 5,326,278

[45] Date of Patent: Jul. 5, 1994

[54] CONNECTOR ASSEMBLY FOR INTERCONNECTING TWO FLAT CABLES

[75] Inventors: Bernard Logerot, Mont-sous-Vaudrey; Jean-Pierre Huguenet, Moissey; Francis Cabane, Dole, all of France

[73] Assignee: Amphenol Socapex, France

[21] Appl. No.: 937,875

[22] PCT Filed: Feb. 17, 1992

[86] PCT No.: PCT/FR92/00151

§ 371 Date: Nov. 20, 1992

§ 102(e) Date: Nov. 20, 1994

[87] PCT Pub. No.: WO92/15131

PCT Pub. Date: Sep. 3, 1992

[30] Foreign Application Priority Data

Feb. 18, 1991 [FR] France ..... 91 01903

[51] Int. Cl.[5] ..... H01R 4/24

[52] U.S. Cl. ..... 439/404; 439/417

[58] Field of Search ..... 439/395–407, 439/417–419, 271–276

[56] References Cited

U.S. PATENT DOCUMENTS

| | | | |
|---|---|---|---|
| 3,214,713 | 10/1965 | Strobel | 339/97 |
| 3,275,968 | 9/1966 | McCaughey | 339/89 |
| 5,049,088 | 11/1991 | Rishworth et al. | 439/417 |
| 5,067,910 | 9/1991 | Knox et al. | 439/417 |

FOREIGN PATENT DOCUMENTS

| | | | |
|---|---|---|---|
| 699570 | 12/1964 | Canada | 439/498 |
| 0242019 | 10/1987 | European Pat. Off. | H01R 9/07 |
| 2643512 | 8/1990 | France | H01R 9/07 |

*Primary Examiner*—David L. Pirlot
*Attorney, Agent, or Firm*—Bacon & Thomas

[57] ABSTRACT

The invention relates to a connector assembly for interconnecting flat cables and comprising two connector portions, each comprising a base and a cover. The cover includes a dome in the form of a spherical cap. Each base includes a cylindrical sealing skirt (28) and a support element (30) for electrical contacts (32). The end faces of the skirt (28*a*) and of the support element (30) lie in a common plane (PP'). The ends (32*a*) of the electrical contacts (32) are set back relative to the plane (PP').

7 Claims, 7 Drawing Sheets

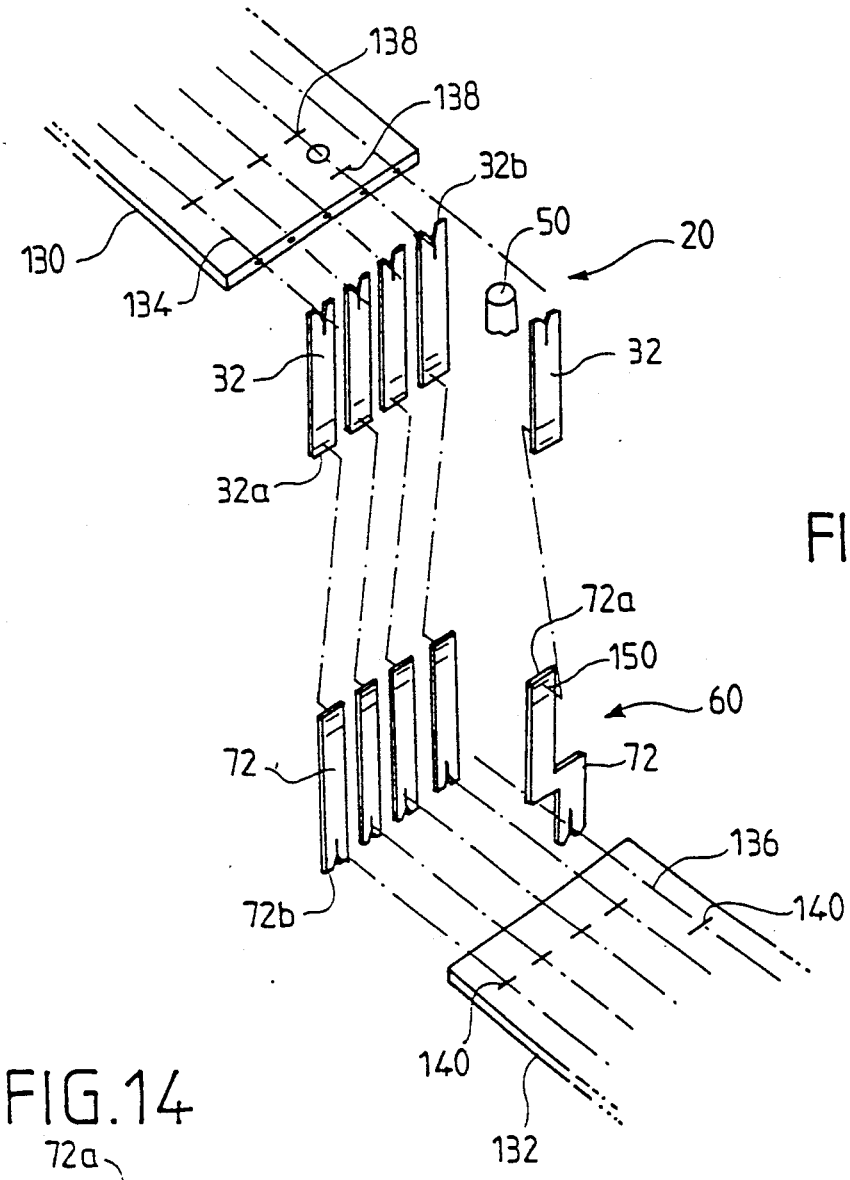
FIG. 13
FIG. 14
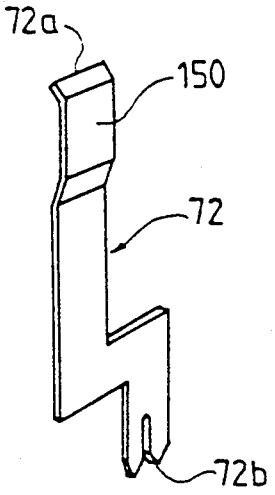
FIG. 15
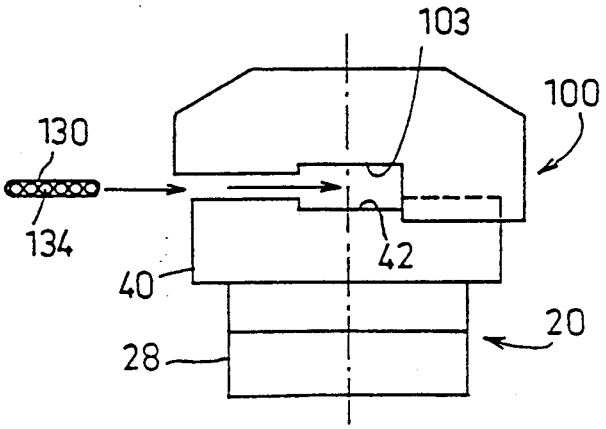

CONNECTOR ASSEMBLY FOR INTERCONNECTING TWO FLAT CABLES

The present invention relates to a releasable connector assembly for interconnecting two flat cables.

The problem of interconnecting two flat cables for the purpose of establishing a set of electrical circuits arises in numerous circumstances. Such flat cables or "ribbon cables" are constituted by a set of electrical conductors disposed side-by-side and embedded in an insulating plastic.

A connector assembly of this type comprises two connector portions, a male portion and a female portion, each constituted by a base and a cover. Each cable is clamped between a face of the base and the cover. To establish electrical connection, the base includes electrical contacts each having respective sharp ends. By pressing the cover hard against the base, the projecting ends of the contacts pierce the insulating covering of the cable, thus providing respective electrical connections between the contacts of the base and the conductors of the cable.

French patent application No. 89 02251 filed in the name of the Applicant describes such a connector assembly. As specified in the above-mentioned document, a connector assembly may be used for establishing series connections or parallel connections between the conductors of the two cables to be interconnected. The present invention is equally applicable to series connection and to parallel connection or to a combination of those two types of connection.

It should also be specified that each connector assembly may either be installed at an end of a cable, or else it may be installed on an intermediate length of the cable. The present invention relates to both types of installation option, or, naturally, to a combination thereof.

In order to wire a cable to a connector portion, a special tool is commonly used enabling sufficient force to be applied between the base and the cover to enable the cable to be pierced right through, as mentioned above. However, there exist some circumstances in which such connector assemblies are used where it is desirable for each connector portion to be capable of being wired to the cable conveniently by hand. It will be understood that if the number of conductors is very small, e.g. two, then piercing the cable presents no particular difficulty. In contrast, with a higher number of conductors, e.g. about five or six, it is generally not possible for conventional connector assemblies to be wired to each cable by hand under conditions that are acceptable.

An object of the present invention is to provide a connector assembly which enables each cable to be wired to each connector portion without requiring the use of a tool.

After each cable has been wired to a connector portion, the two cables are interconnected by engaging the end of the male connector portion in the end of the female connector portion so as to put the contacts in each of said portions into mutual contact. Under some circumstances in which connector assemblies are used, this operation must be performed quickly or under conditions that are difficult. It is therefore important for the ends of the connector portions, and more precisely the ends of the contacts, to be prevented from being damaged in the event of the ends of the male and female connector portions being wrongly presented to each other.

Another object of the invention is thus to provide a connector assembly in which the contacts of the bases cannot be damaged if the male portion is not properly presented to the female portion.

Finally, under certain conditions of use, flat cables may be subjected to accidental traction forces. It will be understood that under such circumstances, these traction forces are applied to the connector assemblies. More particularly, the traction force exerted on the cable is applied to the projecting contact ends in the bases where they perforate the cable. As a result there is a serious risk of the contact ends breaking, thereby breaking the electrical connection.

Another object of the invention is to provide a connector assembly in which such traction forces as may be exerted on the cables are not taken up by the projecting contacts of the bases in the connector assembly.

According to the invention, these aims are achieved by a connector assembly for interconnecting two flat cables, the assembly comprising two connector portions each constituted by a cover and a base, each base having a first end for co-operating with the cover to clamp one of said cables, and a second end for co-operating with the base of the other connector portion, the connector assembly being characterized in that each cover includes a dome substantially in the form of a spherical cap having a diameter lying in the range 25 mm to 60 mm, in that the second end of each base comprises a substantially cylindrical peripheral sealing skirt and a support element for electrical contacts disposed inside the skirt, the electrical contacts not projecting beyond the support element in the longitudinal direction, and in that the end faces of the skirt and of the support element are disposed in a common plane perpendicular to the direction in which the cover co-operates with the corresponding base.

It will thus be understood that because of the special shape of the dome of each cover and because of the fact that the end faces of the sealing skirt and of the support elements for the contacts are disposed in a common plane, mutual wiring is significantly facilitated. Wiring is generally performed with the palm of the hand, and the dome of the cover is particularly well suited to said operation. In addition, because the end faces of the skirt and of the support element disposed inside the skirt lie in a common plane, good support and stability are provided for the sharp projecting contacts when pressure is exerted on the cover of a connector portion for the purpose of perforating the cable.

Other characteristics and advantages of the invention appear more clearly on reading the following description of an embodiment of the invention given by way of non-limiting example. The description refers to the accompanying figures, in which:

FIG. 13 is a diagrammatic view showing the set of conductor elements belonging to the male base and to the female base, showing how they come into contact with one another;

FIG. 14 is a perspective view of an electrical contact element of the male base; and FIG. 15 is a side view of the female connector portion showing a flat cable being inserted therein.

As mentioned above, the connector assembly comprises a male connector portion and a female connector portion. Each connector portion comprises a cover and a base which is male or female as the case may be.

We begin by describing the female base with reference to FIGS. 5 to 8, then the male base with reference to FIGS. 9 to 12, and then, with reference to FIGS. 1 to 4, the cover which is identical for both connector portions.

Figure 7:
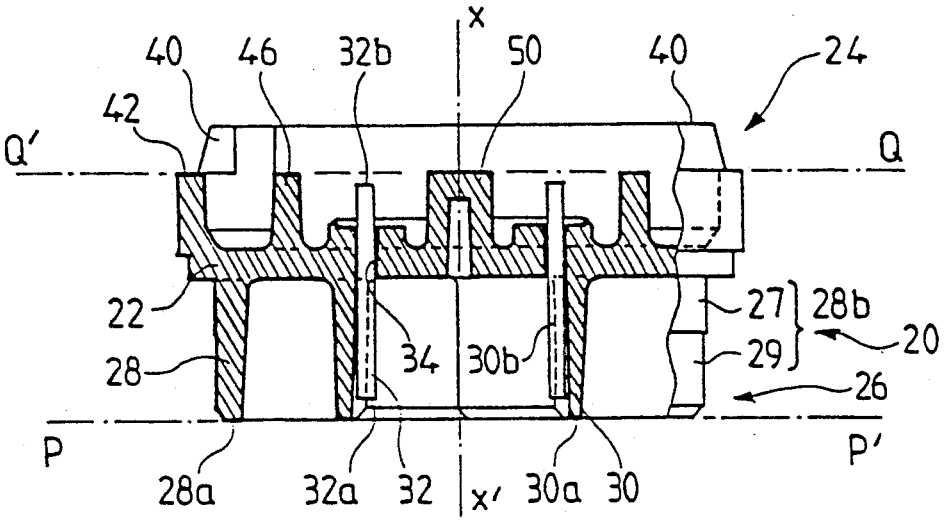
FIG. 7 is a view of the base on line VII—VII of FIG. 5.
Figure 8:
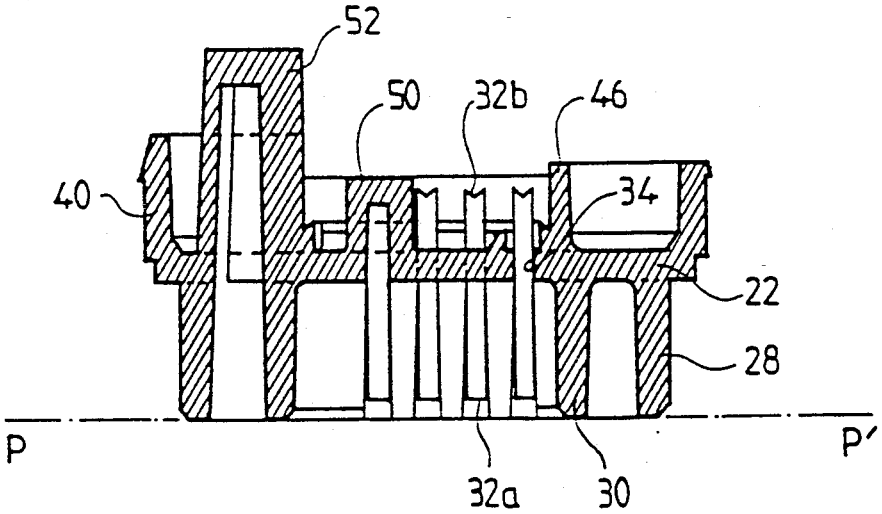
FIG. 8 is a vertical section view of the base on line VIII—VIII of FIG. 5.
Figure 9:
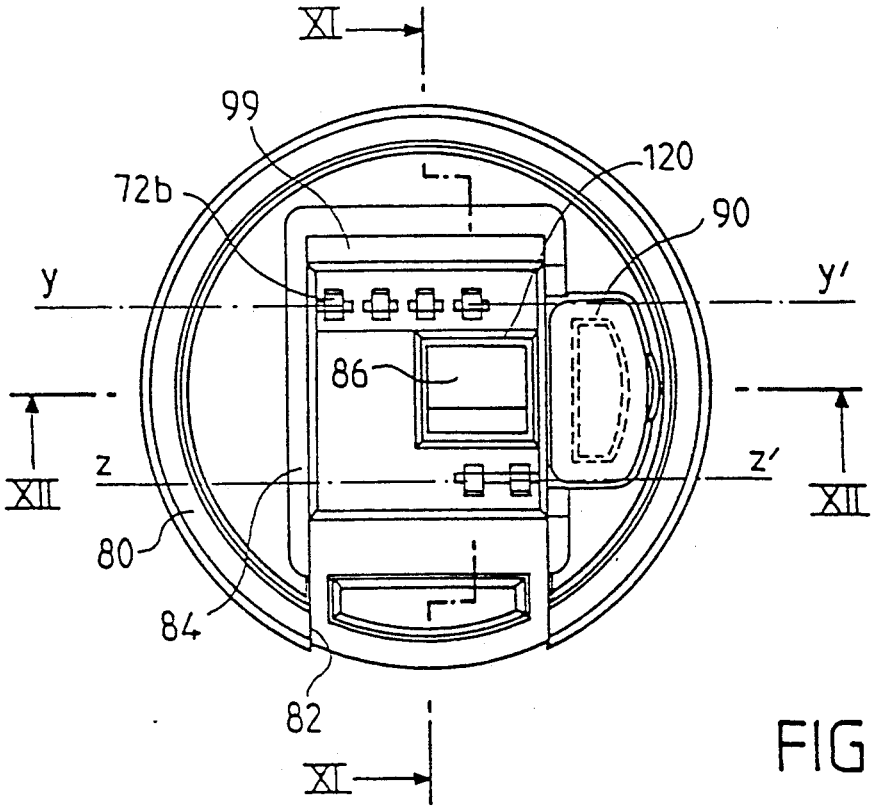
FIG. 9 is a view from above of the male base of the connector assembly.

As shown more particularly in FIGS. 7 and 8, the female base 20 comprises a baseplate 22 extending perpendicularly to the axis XX' of the base 20. On opposite sides of the baseplate 22 there are a first end 24 for co-operating with the cover that is associated with the base, and a second end 26 for co-operating with the second end of the male base. The second end 26 of the base is essentially constituted by a substantially cylindrical sealing skirt 28 having a support element 30 therein which serves essentially for guiding and holding contacts such as 32. The contacts 32 are described in detail below, and they pass through the baseplate 22 via orifices such as 34. Each contact 32 has a bottom end 32*a* for making electrical contact with the equivalent end of a contact in the male base, and a "projecting" second 32*b* disposed at the first end 24 of the base and which includes a sharp portion. The projecting end 32*b* is designed to perforate the flat cable to provide an electrical connection between itself and one of the conductors of the cable.

As can be seen in FIGS. 7 and 8, the end face 28*a* and the end face 30*a* respectively of the sealing skirt 28 and of the support element 30 lie in a common plane PP' which is perpendicular to the axis XX' of the base. The ends 32*a* of the contacts 32 are set back a little from the plane PP'.

Figure 6:
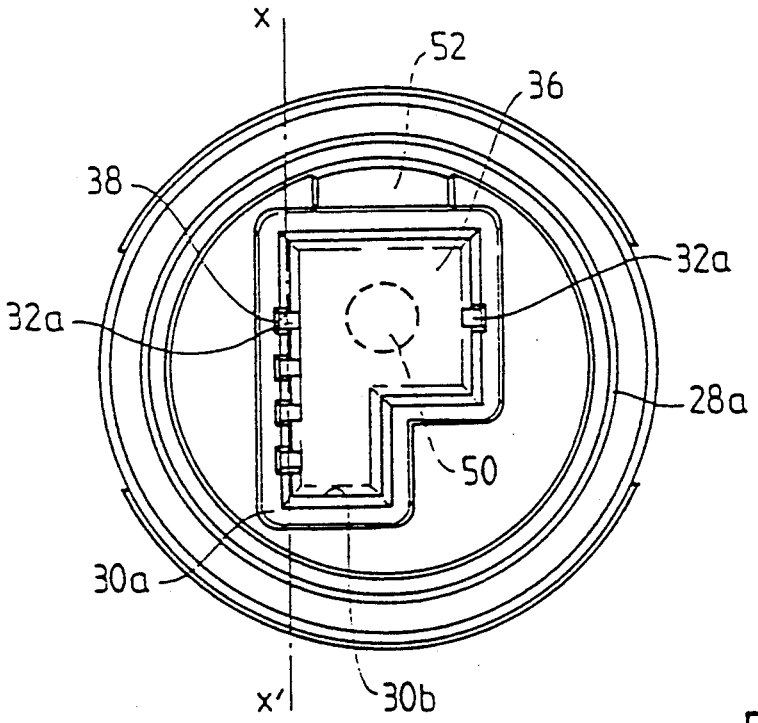
FIG. 6 is a view from below of the FIG. 5 base.

FIG. 6 shows the end face 28*a* of the sealing skirt, the ends 32*a* of the contacts 32, and the end face of the support element 30. In this particular embodiment, it can be seen that the support element 30 is polygonal in shape, defining an inside space 36 for receiving the corresponding portion of the male base. As can be seen more clearly in this figure, the contacts 32 are essentially housed in longitudinal cavities 38 formed in the support element 30.

The top end 24 of the female base has an annular rim 40 which is interrupted by two diametrically opposite notches 42 and 44. As explained below, these notches serve to pass the flat cable to be connected. In alignment with the notches 42 and 44, there is a projecting rib 46 in the form of a substantially rectangular frame which stands proud of the baseplate 22. As can be seen more clearly in FIG. 7, the notches 42 and 44 and the rib 46 lie substantially in a common plane QQ' which is closer to the baseplate 22 than is the top face of the rim 40. The projecting ends 32*b* of the contacts are set back relative to the plane QQ'. The end 24 of the base 20 also includes a cutting-out peg 50 disposed between the contact ends lying on the line xx' of FIGS. 5 and 6 and the isolated contact referenced 32'. The cutting-out peg 50 is an integral portion of the baseplate 22 and its end also lies substantially in the common plane QQ'.

The end 24 of the base 20 also includes a guide column for the associated cover, which column is referenced 52. The column 52 is disposed outside the rectangular rib 46, and away from the space defined by the notches 42 and 44. As explained in greater detail, the column 52 is designed to guide and position the cover relative to the base 20 while the flat cable is being wired thereto.

Figure 10:
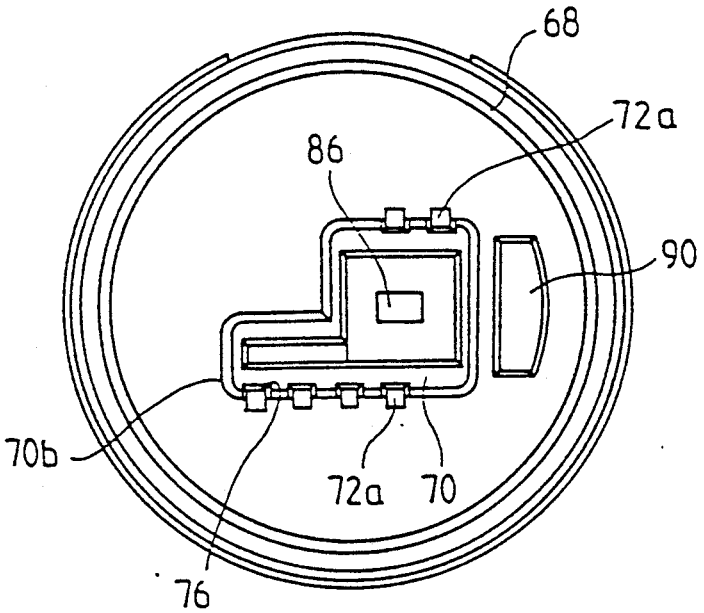
FIG. 10 is a view from below of the FIG. 9 base.
Figure 11:
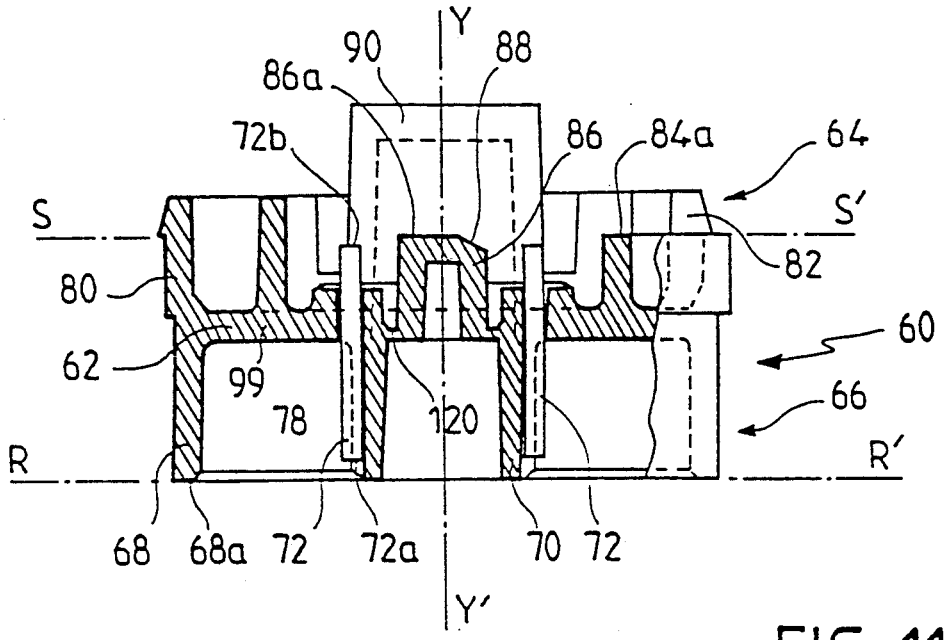
FIG. 11 is a vertical section view of the base of FIG. 9 on line XI—XI.
Figure 12:
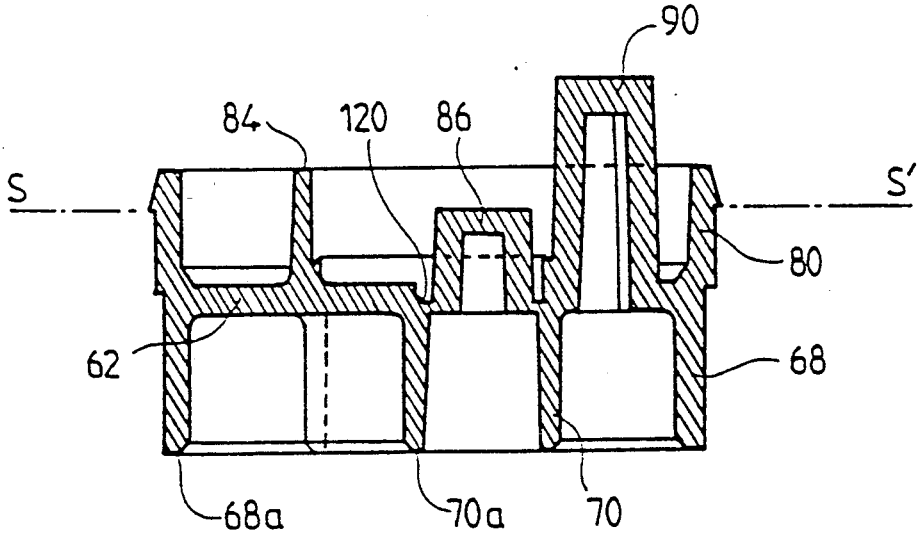
FIG. 12 is a vertical section view of FIG. 9 on line XII—XII.

With reference now to FIGS. 9 to 12, there follows a description of the male base designed to co-operate with the above-described female base 20. The male base 60 likewise includes a circular baseplate 62. On either side of the baseplate 62 there are a first end 64 for co-operating with the cover of the male connector portion, and a second end 66 for co-operating with the second end 26 of the female base 20. The end 66 of the base 60 is essentially constituted by a substantially cylindrical sealing skirt 68 for co-operating with the sealing skirt 28 of the base 20. Inside the skirt 68, there is a contact support element 70. In FIG. 11, the contacts of the male base 60 are referenced 72. As for the female base, the end face 68*a* of the skirt 68 and the end face 70*a* of the support element 70 lie in a common plane RR' perpendicular to the axis YY' of the male base. The ends 72*a* of the contacts are set back relative to the plane RR'.

As can be seen more clearly in FIG. 10, the contact support element 70 is polygonal in shape and its outside wall 70*b* corresponds to the inside wall 30*b* of the support element of the female base. Housings 76 are provided in said wall for holding the contacts 72. The contacts 72 pass through the baseplate 62 via orifices such as 78.

With reference now to the top end 64 of the male plate, it can be seen that it includes a substantially cylindrical peripheral rim 80 which is interrupted by a single notch 82 for receiving the end of a flat cable that is to be electrically connected to the corresponding connector portion.

The top end 64 also includes a rib 84 defining a substantially rectangular outline which projects from the baseplate 62 of the base 60. The projecting ends 72*b* of the contacts lie within the surface portion defined by the rectangular rib 84. These contacts are disposed firstly on a line yy' and secondly on a line zz', which lines are parallel. Between these two lines of contacts, there is a stud 86 for guiding the end of the flat cable. Its base is substantially rectangular and lies between the two lines of projecting contacts.

As can be seen more clearly in FIG. 11, the guide stud 86 has a chamfered portion 88 directed towards the notch through which the flat cable 82 is inserted. More particularly, FIG. 11 shows that the top face 84*a* of the rib 84 and the top face 86*a* of the guide stud 86 lie substantially in a common plane SS' perpendicular to the axis YY' of the male base 60. The projecting contacts 72*b* are set back from said plane. In addition, a recess 99 is formed in the baseplate close to the portion of the rib 84 furthest from the insertion notch 82. The recess 99 is designed to receive grease for the purpose of electrically insulating the end of the cable.

Finally, like the female base, the top end 64 of the male base 60 includes a guide column 90 for co-operating with a corresponding recess formed in the cover associated with the male base.

With reference now to FIGS. 1 to 4, there follows a description of the cover 100 which is the same for the male base and for the female base.

Figure 1:
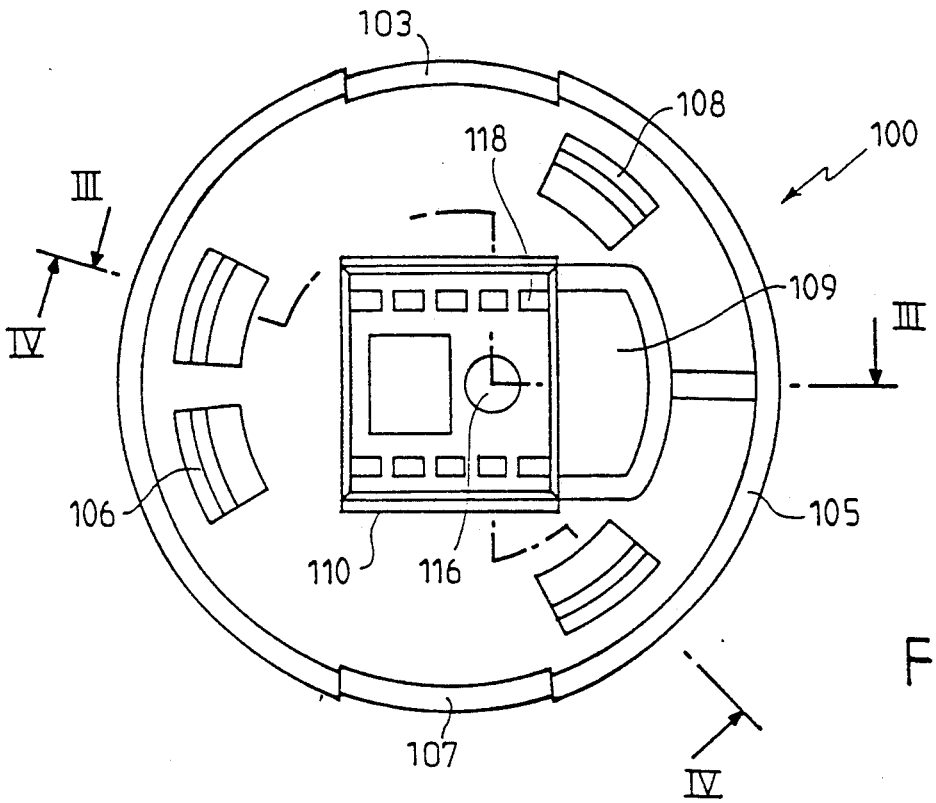
FIG. 1 is a view from beneath of a cover of a connector assembly.
Figure 2:
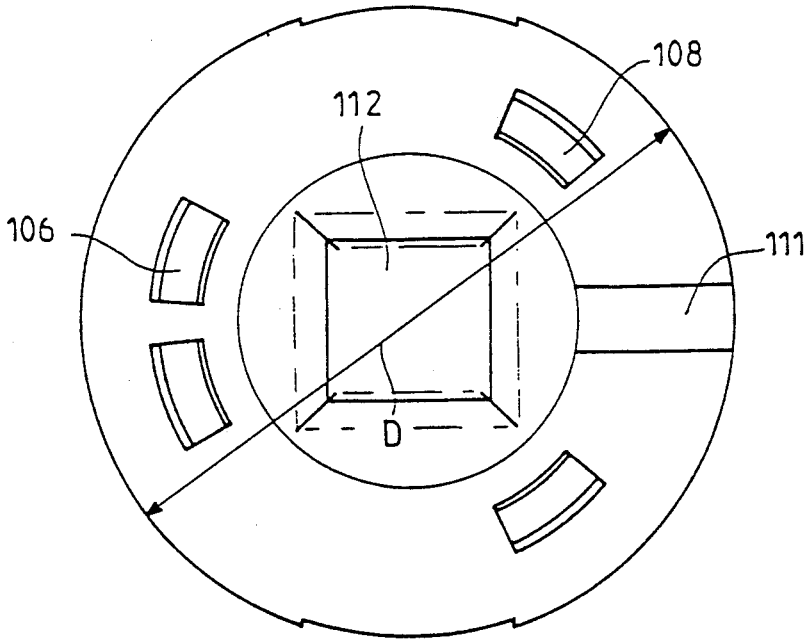
FIG. 2 is a view from above of the FIG. 1 cover.
Figure 3:
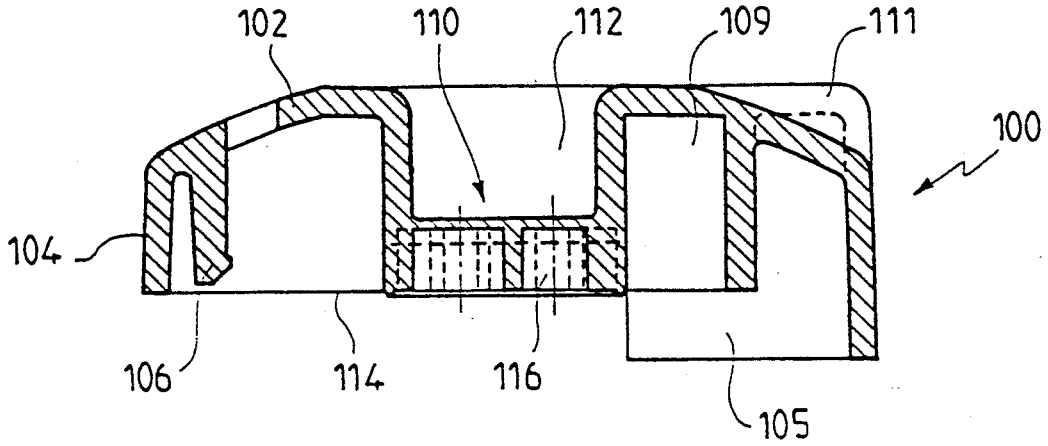
FIG. 3 is a vertical section on line III—III of FIG. 1.
Figure 4:
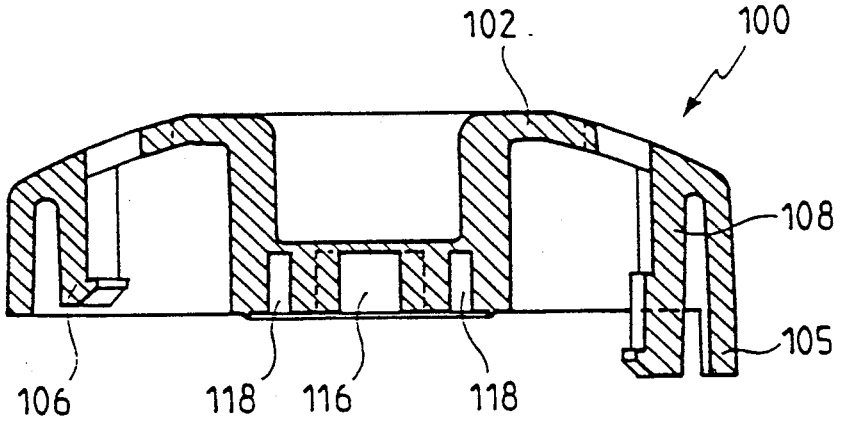
FIG. 4 is a vertical section through the cover on line IV–IV of FIG. 1.
Figure 5:
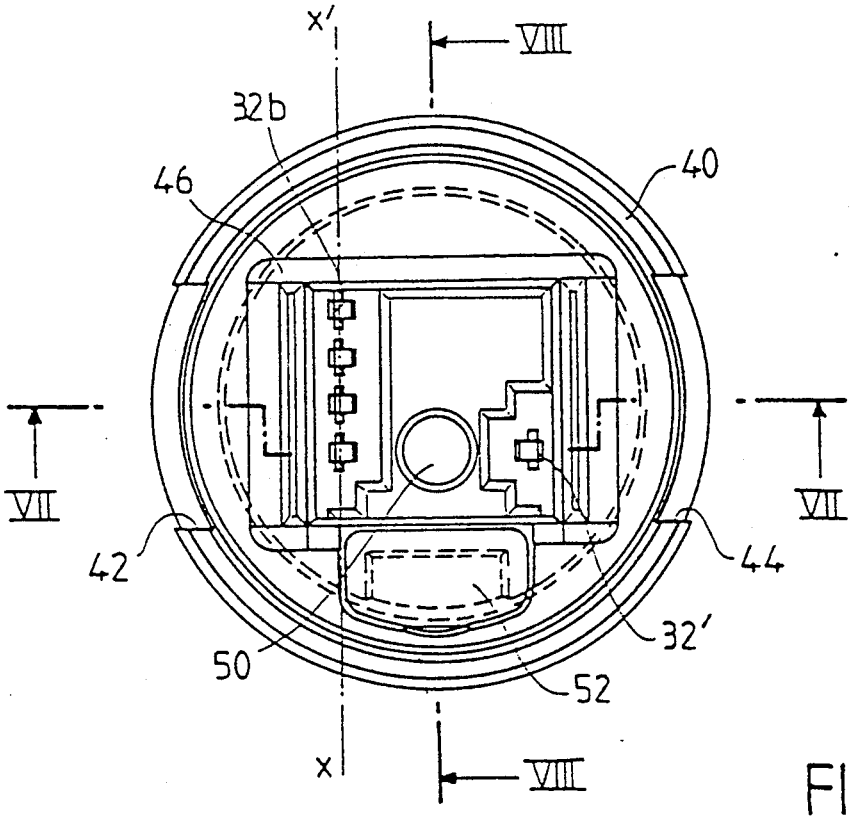
FIG. 5 is a view from above of the female base of the connector assembly.

FIGS. 3 and 4 show that the cover 100 is constituted by a dome 102 which is generally in the form of a spherical cap whose base diameter D is substantially equal to 40 mm. More generally, said diameter may lie in the range 25 mm to 60 mm. The periphery of the dome 102 is provided with a cylindrical rim 104 which includes a taller portion 105 and two notches 103 and 107 corresponding to the notches 42 and 44 of the female base 20. The dome 102 also includes flexible catch elements 106 and 108 for engaging the male base or the female base. These catch elements 106 and 108 co-operate with different portions of the cylindrical rim 42 of the female base (or 80 of the male base). The catch elements 108 are longer than the catch elements 106. When the connector assembly is delivered, the bases 20 and 60 are secured to their respective covers 100 by means of the longer catch elements 108 which co-operate with the rims of the bases associated therewith. In addition, the recess 109 co-operates with the guide column 52 of the female base. The cover 100 also includes a central portion 110 which defines a recess 112 that opens out into the top face of the dome 102. This recess 102 makes it optionally possible to wire the flat cable to the connector portion by means of a tool. The bottom face 114 of the central zone 110 of the cover 100 also defines a first recess 116 for co-operating with the cutting-out peg 50 should the cover be associated with the female base. It also includes recesses such as 118 which face the projecting ends **32*b* of the contacts in the female base or 72*b* of the contacts in the male base, and serving to receive said projecting ends during the wiring operation. Finally, the dome 102 includes a radial reference 111**.

FIG. 13 shows how an electrical connection is made between a first flat cable 130 and the female base 20, how electrical connection is made between a second flat cable 132 and the male base 60, and how the bases 20 and 60 are coupled together.

In this figure, the conductors in the cable 130 are referenced 134 and the conductors in the cable 132 are referenced 136. Each sharp end **32*b* of a contact 32 of the female base 20 perforates the covering of the cable 130 to establish electrical connection with the corresponding conductor 134. Lines referenced 138 symbolize such perforations. Similarly, each sharp end 72*b* of a contact 72 of the male base 60 perforates the covering of the cable 132 to establish electrical connection with the corresponding conductor 136. Lines 140** symbolize these perforations.

The bases 20 and 60 are interconnected by engaging the support element 70 of the male base 60 in the support element 30 of the female base 20. This engagement causes the ends **32*a* of the contacts 22 to be pressed against the ends 72*a* of the contacts 72**.

As can be seen more clearly in FIG. 14, the end **72*a* of a contact 72 is folded to form a bulge 150 having a midpoint. All of the contacts 32 and 72 have the same kind of bulge 150. When the male and female bases are connected together, the bulges 150 of the contacts serve not only to provide electrical connection but also to provide mechanical fastening. When the male and female bases are fully engaged, the midpoints of the bulges 150 on the contacts of one set have moved past the midpoints of the bulges 150** on the contacts in the other set by subjecting the bulges to temporary elastic deformation.

There follows a description of how to wire a flat cable to the female connector portion, and then of how to wire a flat cable to the male connector portion, and finally of how the connector portions are coupled together.

For the female connector portion 20, the flat cable is placed in the notches 42 and 44. Consequently, a portion of said cable overlies the projecting top ends **32*b* of the contacts and the cutting-out peg 50. The cover 100 is already pre-secured to its base 20 in such a manner that the guide column 52 penetrates into the associated recess 109 of the cover 100, with the prefastening catch elements 108 being engaged with the rim of the base. The flat cable is installed sideways via the side of the connector portion which does not include the larger portion 105 of the edge of the cover, as can be seen in FIG. 15. The end faces of the peripheral skirt 28 and of the support element 30 lying in the plane PP' are placed on any stable support, and then the user of the connector assembly exerts pressure or shock on the dome 102 of the cover 100 using the palm of the hand or the fist, thereby causing the flat cable to be pierced by the projecting sharp ends 32*b* of the contacts co-operating with the recesses 108 formed in the face 114 of the cover, and with the flat cable being cut out in a region that corresponds to the cutting-out peg 50 which co-operates with the associated recess 116 formed in the cover. When the cover 100 comes into abutment at the end of its stroke, the catch elements 106 and 108 of the cover 100 co-operate with corresponding portions of the peripheral rim of the base 20 so as to lock the cover 100 on the base 20. It should also be observed that because of the presence of the rectangularly-shaped rib 46 which is disposed above the top face of the baseplate 22 of the base 20, the portion of the flat cable engaged between the base and the cover is folded into a U-shape and is clamped between the rib 46 and the central portion 110 of the cover 100**. It will be understood that this clamping of the flat cable between the cover and the base provides mechanical retention of the cable between these two parts, thereby avoiding any need for the projecting contacts to perform this function.

The flat cable is wired to the male connector portion as shown in FIGS. 9 to 12 in a mariner that differs from wiring the female connector portion in that the connector portion is wired to the end of the flat cable. To do this, the end of the cable is presented to the notch 82 in the male base and is inserted until it comes into abutment against the end portion of the peripheral rib 84. During such insertion, the cover 100 is already prefastened to the base 60 by the catch elements 108 as explained above. This insertion is facilitated by the presence of the guide stud 86 between the two rows of contact elements **72*b* and more precisely by the chamfered portion 88 thereof. In this way, if the end of the flat cable is somewhat curved, it is nevertheless prevented from coming into abutment with the projecting ends of the contacts 72 lying on the line yy', instead of passing over them. It will also be understood that when pressure is applied to the corresponding cover 100 under conditions identical to those described above with reference to the female connector portion, the guide stud 86 is broken by the bottom face 114 of the central portion 116 of the cover 100. To facilitate such separation, the baseplate of the male base includes a region of reduced thickness 120 around the base of the guide stud 86, thereby constituting a line of weakness which breaks when pressure is applied. Once the guide stud 86 has been broken, it will be understood that the process described above with reference to the female base causes the sharp ends 72***b* of the contacts 72 to perforate the flat cable and thus make electrical connection therewith. As with the female base, because of the rib 84 projecting above the baseplate, the end of the flat cable is folded and becomes clamped between the rib 84 and the central portion 110 of the cover. A mechanical connection is thus obtained between the end of the cable and the connector portion, and the advantage thereof is explained below.

The female base 20 is coupled with the male base 60 by engaging the contact support element 70 inside the contact support element 30 of the female base. The index 111 on each of the covers 100 of the male and female connector portions facilitates proper presentation of the connector portions for coupling purposes, which happens when the two indexes coincide. Simultaneously, co-operation is obtained between the cylindrical sealing skirt 28 of the female base inside the cylindrical sealing skirt 68 of the male base. When these two parts come into abutment, sealing is obtained between the male and female bases, and so also is mechanical connection, and this is reinforced by the bulges 150 of the contacts 32 and 72 co-operating as explained above. It should be added that the outside face 28*b* is in fact made up of two cylindrical surfaces 27 and 29. The surface 27 closer to the baseplate 52 is slightly greater in diameter than the surface 29. Thus, when the skirt 68 is engaged around the skirt 28, sealing is achieved only at the end of the stroke at the sealing surface 27. This avoids compressing too large a volume of air between the sealing skirts which could run the risk of causing the bases to decouple accidentally.

In the above description, the female base 20 is of a type suitable for series or parallel connection as described in the above-mentioned patent application, and the flat cable is wired to the connector portion via an intermediate length of the cable. In contrast, the male base is suitable for parallel connection only and the cable is wired thereto at its end. Naturally, all combinations are possible both with respect to the way in which wiring is performed and with respect to the series and/or parallel nature of the connections to be established.

Finally, it should be added that the sealing skirt 28 and the electrical conductor support 30 in the female base 20 are directly connected to the baseplate 22 without any other "bridge" between them. Thus, while the female base 20 is being molded there is no risk of shrink marks occurring on the outside face of the skirt which would naturally make sealing impossible.

We claim:

1. A connector assembly for interconnecting two flat cables, the assembly comprising a male connector portion and a female connector portion, each connector portion being constituted by a cover and a base, each base having a first end for co-operating with said cover for wiring one of said cables, and a second end for co-operating with the base of the other connector portion, the connector assembly being characterized in that each cover includes a dome substantially in the form of a spherical cap whose diameter lies in the range of 25 mm to 60 mm, in that said second end of each base includes a substantially cylindrical sealing skirt and a contact support element for support contacts disposed inside said skirt, in that end faces of said skirts and of said support elements are disposed substantially in common planes perpendicular to an axis of the bases, and in that first ends of said contacts are set back relative to said support elements.

2. A base according to claim 1, wherein the dome of each cover includes an index member which facilitates coupling of the male and female connector portions by the index members being brought into coincidence.

3. A connector assembly according to claim 1, wherein each base includes a substantially cylindrical baseplate, in that second ends of the contacts project proud from said baseplate in said first end of the base, in that said first end of the base further includes a rib projecting from said baseplate and surround a set of said second ends of the contacts, and in that a face of each cover facing the corresponding base includes a central portion pierced by orifices for receiving the second ends of the contacts, said central portion being suitable for penetrating into a zone defined by said rib of the base, whereby each cable is clamped between said rib and said central portion and takes up a U-shaped outline whereby the contacts are not subjected to mechanical forces applied to the cable.

4. A connector assembly according to claim 3, wherein at least one of the connector portions is designed to receive the end of a cable and in that the base of said connector portion includes a guide stud in its first end, said stud projecting beyond said baseplate to substantially the same height as said second ends of the contact and being disposed between the contacts, said guide stud being connected to the remainder of said baseplate by a portion of reduced thickness forming a line of weakness whereby said stud is separated from said baseplate when said cover is pressed against said base.

5. A connector assembly according to claim 1, wherein the outside face of the sealing skirt of one of the bases and suitable for cooperating with the inside face of the sealing skirt of the other base includes a first cylindrical portion close to the baseplate and having a diameter slightly greater than the diameter of the remainder of said skirt, said first cylindrical portion forming the sealing surface with the other skirt.

6. A connector assembly according to claim 1, wherein each contact includes a bulging portion close to its first end and suitable for coming into contact with the corresponding portion of a contact of the other base when the two bases are interconnected.

7. A connector assembly according to claim 6, wherein each bulging portion of the contacts has a midpoint, and in that the midpoint of the bulging portion of a contact goes past the midpoint of the bulging portion of the associated contact whereby a mechanical connection is obtained when the two bases are fully coupled together.

* * * * *